United States Patent [19]

Nichols

[11] 4,044,912

[45] Aug. 30, 1977

[54] LINED CONTAINER FOR STORING AND TRANSPORTING THICK VISCOUS SUBSTANCES SUCH AS GREASE HAVING ANTI-CLOGGING LINER SUPPORT

[75] Inventor: Dwight E. Nichols, Beatrice, Nebr.

[73] Assignee: Hoover Ball and Bearing Company, Saline, Mich.

[21] Appl. No.: 693,101

[22] Filed: June 4, 1976

[51] Int. Cl.[2] ..... B65D 25/16

[52] U.S. Cl. ..... 220/63 R; 222/95

[58] Field of Search ..... 220/63 R, 65; 222/95, 222/125, 107, 173, 183, 372, 385, 386.5, 564

[56] References Cited

U.S. PATENT DOCUMENTS

| | | | |
|---|---|---|---|
| 2,954,892 | 10/1960 | Dasker | 220/63 R X |
| 3,122,000 | 2/1964 | Sirocky | 222/386.5 X |
| 3,383,875 | 4/1963 | Welty et al. | 222/95 |
| 3,388,832 | 6/1968 | Stewart et al. | 222/386.5 X |
| 3,389,833 | 6/1968 | Ramis | 222/95 |
| 3,420,413 | 1/1969 | Wrsette | 222/107 |
| 3,590,888 | 7/1971 | Coleman | 220/63 R X |
| 3,747,800 | 7/1973 | Viland | 222/95 X |

*Primary Examiner*—Stephen Marcus
*Attorney, Agent, or Firm*—Olsen and Stephenson

[57] ABSTRACT

A container consisting of a rigid outer tank having a collapsible bag liner for retaining viscous substances such as grease. A vane shape spacer assembly is disposed inside the bar and secured to the open upper end of the bag to provide a skeletal structure about which the bag can collapse as the grease is being removed to thereby insure more complete evacuation of a filled tank than has heretofore been possible.

5 Claims, 3 Drawing Figures

LINED CONTAINER FOR STORING AND TRANSPORTING THICK VISCOUS SUBSTANCES SUCH AS GREASE HAVING ANTI-CLOGGING LINER SUPPORT

BACKGROUND OF THE INVENTION

This invention relates generally to material handling apparatus and more specifically to a tank for storing and transporting thick viscous substances such as grease.

Presently, greases and other similar viscous materials are usually shipped and stored in metal drums. These drums are usually emptied by a grease pump and then returned for refilling. It has been found that by this method only about two-thirds of the drum's contents can be removed so that extra handling and costs are incurred in storing and returning partially filled drums.

It is an object, therefore, of the present invention to provide an improved tank for storing and transporting substances such as grease which can be more completely evacuated than has heretofore been possible.

SUMMARY OF THE INVENTION

The present invention consists of a rectangular tank having a collapsible bag liner which, when filled with a substance such as grease, expands and conforms substantially to the configuration of the inner surface of the tank. The tank has a top wall filling and discharge opening and the bag has a similar opening aligned with the tank opening. A spacer assembly is located inside the bag and secured to the outlet opening of the bag so that when the grease is evacuated from the bag, it will collapse about the spacer assembly.

The spacer assembly comprises a plurality of frame members arranged like radiating vanes and extending vertically in the bag member between the top and bottom walls of the container. The frame members cooperate with a bottom retainer plate that is disposed in the bag at the bottom wall of the container so that a passageway between the bottom wall and the bag opening is formed as the bag collapses around the spacer assembly. This structure enables substantially all of the grease to be removed from the tank, and, if desired, the finally collapsed bag and the spacer assembly can be removed from the tank.

Further objects, features and advantages of the present invention will become apparent from a consideration of the following description when taken in connection with the appended claims and the accompanying drawings in which:

Figure 1:
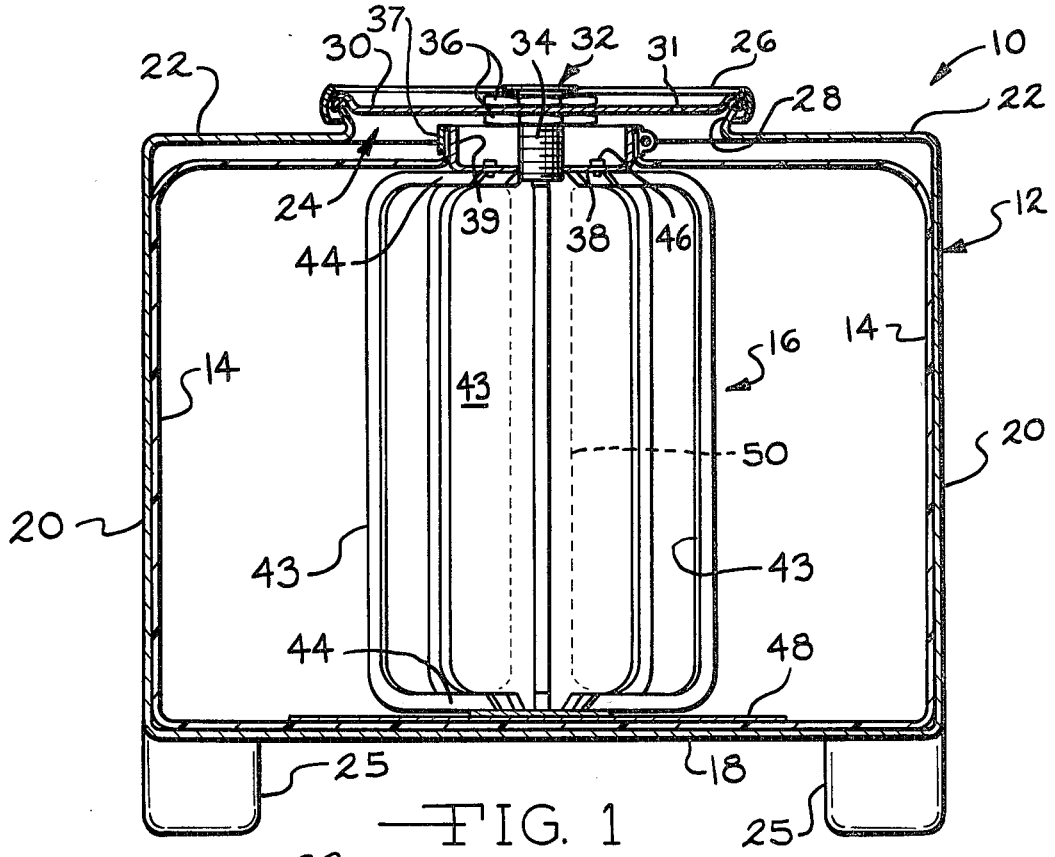
FIG. 1 is a vertical sectional view of the container of this invention showing the liner bag in expanded position.

Referring to the drawing, the container of this invention, shown generally at 10 in FIG. 1, consists of a rectangular tank 12, a collapsible bag 14 and a spacer assembly 16. The rectangular tank 12 has a bottom wall 18, side wall 20 and a top wall 22 provided with a filling and discharge opening 24 about which an upright flange 28 is integrally formed with the top wall 22. Container legs 25 are provided to aid in storing and transporting the tank 10.

A cover 30 is removably mounted on the flange 28 and serves to maintain a discharge unit 32 for the bag 14 in a fixed position. The cover 30 is held in position against the flange 28 by a drum closure ring 26. A vent 31 is formed in the plate 30 to allow air to transfer between the container 12 and the surrounding environment as the bag 14 is filled and emptied. The discharge unit 32 can be connected to a pump (not shown) or other similar device for evacuating material from the bag 14 to empty the container 10. The discharge unit 32 comprises a vertical pipe 34 having its outer surface threaded to receive a pair of sleeve nuts 36 which straddle the cover 30 to hold the pipe 34 in its fixed position.

The bag 14 is formed of a heavy gage flexible plastic or other suitable flexible material and when filled with grease conforms substantially to the rectangular inner surface of the tank 12 as shown in FIG. 1. The bag 14 is secured by a ring clamp 37 to a plate or hub 38, which is in turn threadably secured in fluid tight relation to the pipe 34. The plate 38 has an upright peripheral flange 39 to which the ring clamp 37 seals in fluid tight relation the bag 14 so that the only access to the bag 14 is through the pipe 34.

Figure 2:
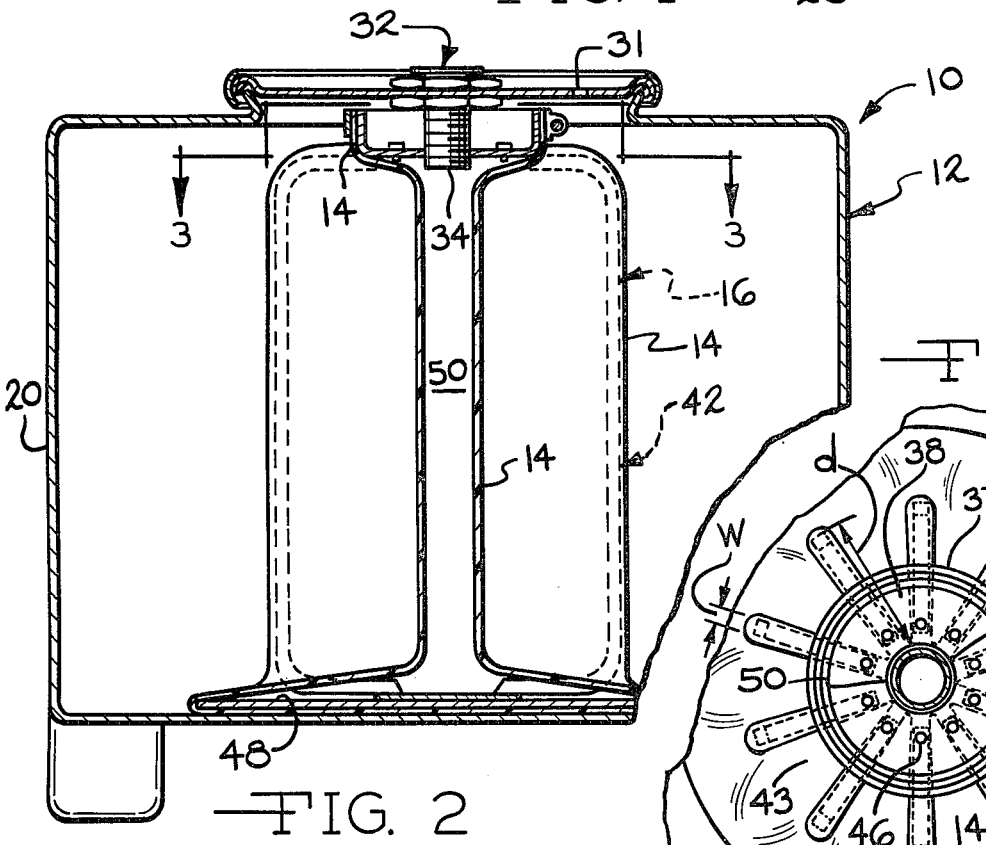
FIG. 2 is a sectional view like FIG. 1 of the container of this invention showing the bag in collapsed position.
Figure 3:
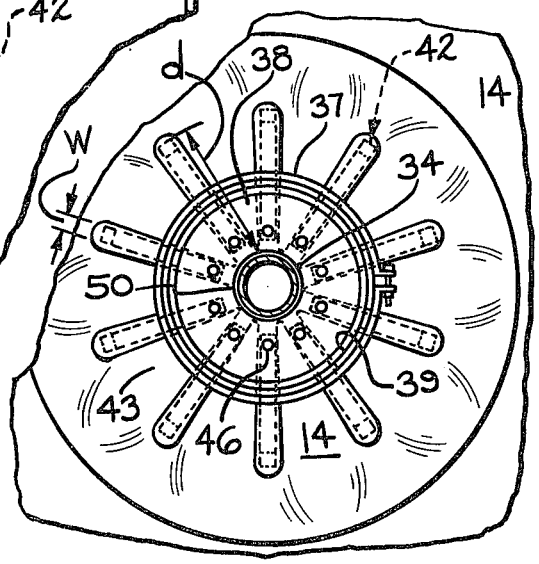
FIG. 3 is a top view of the container taken substantially at the line 3—3 of FIG. 2.

The spacer assembly 16 is positioned inside the bag 14 to surround the pipe 34 and consists of a plurality of C-shaped frame members 42, each having a main portion 43 and laterally extending ends 44. The frame members 42 radiate outwardly from the hub 38 and from the pipe 34 an equal distance as shown in FIG. 3 so that they form a vane-like arrangement. The frame members 42 are spaced apart a distance sufficient to form a passageway 50 (FIG. 2) when the bag 14 is completely collapsed about the assembly 16. The circumferential distance of the expanded bag 14 approximates the perimetrical distance about the spacer assembly 16 so that the bag 14 remains relatively unstretched and does not fold over itself when collapsed about the spacer assembly 16. Assuming that the members 42 are symmetrically positioned about the pipe 34 as shown in FIG. 3, the perimetrical distance approximately equals the number of members 42 times the sum of twice the distance $d$ plus the width $w$, where $d$ equals thedistance between the outer surface of the member 42 and the outer boundary of the passageway 50 and where $w$ equals the width of a member 42. If the members 42 are otherwise positioned, ther perimetrical distance can easily be measured and the members 42 repositioned in accordance with the circumference of the bag 14 to insure that it properly collapses about the spacer assembly 16 to form the passageway 50.

The upper end 44 of each member 42 is secured to the hub 38 by the bolts 46. The members 42 extend between the top wall 22 and the bottom wall 18 and together with a retainer plate 48 form a skeletal structure about which the bag 14 collapses as grease is being removed. The retainer plate 48 is located inside the bag 14 adjacent the bottom wall 18 and cooperates with the spacer assembly 16 to assure that the bag 14 properly collapses as the grease is being evacuated so that the bag 14 does not block the pipe 34.

In operation, the container 10 is filled with grease so that the bag 14 expands to the position shown in FIG. 1. When the contents of the container 10 is removed, a vacuum pump, or other similar device connected to the pipe 34 is to be used. During removal, the bag 14 collapses about the spacer assembly 16. As the bag 14 collapses, the spacer assembly 16 prevents it from obstructing the pipe 34. FIGS. 2 and 3 show the bag 14 completely collapsed about the spacer assembly 16 and, as can be seen, the passageway 50 is formed betweens the pipe 34 and the retainer plate 48. By collapsing the bag 14 in such a manner, a maximum amount of grease is forced in the vicinity of the pump to thus empty the bag 14 as much as is practicably possible without obstructing the pipe 34. This assures most efficient utilization of the container 10 which results in reduced handling and lowering shipping and storage costs.

What is claimed:

1. In a container for storing and transporting material, an upright collapsible bag having a single opening at the upper end thereof, and a spacer assembly disposed inside said bag and aligned with said opening, said spacer assembly comprising a central hub member and a plurality of spaced apart frame members radiating outwardly from said hub member, said hub member being annular in shape and being secured to said frame members at the upper ends thereof, said hub member being disposed within the open upper end of said bag member, means securing said hub member in fluid tight relation to said upper end of said bag member, each of said frame members being of generally C-shape so that each has a main upright portion and laterally extending end portions, the end portions at the upper ends of said frame members being secured to said hub members, and a base member secured to the end portions at the lower ends of said frame members.

2. A container according to claim 1 wherein said bag is of a predetermined circumferential dimension in a horizontal plane, and said spacer assembly is of a predetermined perimetrical dimension along the outer perimeter thereof, and wherein said circumferential and perimetrical dimensions are substantially equal.

3. A container for storing and transporting a thick viscous substance such as grease comprising a tank having top, side and bottom walls defining a hollow enclosure, a collapsible bag disposed in said tank and conforming substantially to the configuration of said hollow enclosure when filled with said substance, said top wall having a filling and discharge opening formed therein, a spacer assembly disposed inside said bag in a position substantially aligned with said discharge opening and extending from top to bottom in said bag, said bag having an open upper end substantially aligned with said discharge opening and being collapsible about said spacer assembly as said substance is being removed through said bag upper end to thereby facilitate discharge of said substance from said container, said spacer assembly comprising a hub member and a plurality of spaced apart upright frame members radiating outwardly from said hub member, said hub member being secured to said frame members at the upper ends thereof and being disposed within and secured in fluid tight relation to said open upper end of said bag, a cover mounted on said top walls so as to close said filling and discharge opening, and a discharge member mounted on and extending through said cover and said hub member so as to communicate with the interior of said bag at a position substantially aligned with respect to said spacer assembly and said bag opening.

4. A container according to claim 3 wherein said spacer assembly also includes a base member disposed inside said bag member and arranged to clamp said bag member against said bottom wall, said base member being secured to and arranged in a supporting relation with the lower ends of said frame members.

5. The container according to claim 3 wherein said bag is of a predetermined circumferential dimension in a generally horizontal plane and said spacer assembly is of a predetermined perimetrical dimension along the outer perimeter thereof, said dimensions being substantially equal so that on removal of said substance through said discharge member said bag is collapsible onto said spacer assembly.

* * * * *